US007484700B2

(12) United States Patent
Selle

(10) Patent No.: US 7,484,700 B2
(45) Date of Patent: Feb. 3, 2009

(54) LEVELING DEVICE AND METHOD FOR MAKING SAME

(75) Inventor: Stephen R. Selle, Mentor, OH (US)

(73) Assignee: Stafast Products, Inc., Painesville, OH (US)

( * ) Notice: Subject to any disclaimer, the term of this patent is extended or adjusted under 35 U.S.C. 154(b) by 0 days.

(21) Appl. No.: 11/673,059

(22) Filed: Feb. 9, 2007

(65) Prior Publication Data

US 2008/0191111 A1 Aug. 14, 2008

(51) Int. Cl.
*F16M 11/24* (2006.01)

(52) U.S. Cl. ..... 248/188.4; 248/346.11

(58) Field of Classification Search ..... 248/188.4, 248/188.2, 188.8, 188.9, 346.11; 16/32, 16/35 R, 42 R; 411/304, 301, 246, 247, 353, 411/999

See application file for complete search history.

(56) References Cited

U.S. PATENT DOCUMENTS

| | | | | |
|---|---|---|---|---|
| 4,770,275 | A | 9/1988 | Williams | |
| 4,991,365 | A | 2/1991 | Jackson | |
| 5,108,238 | A | 4/1992 | Ewing | |
| 5,138,814 | A | 8/1992 | Giles et al. | |
| 5,297,851 | A | 3/1994 | Van Hekken | |
| 5,993,320 | A | 11/1999 | Selle | |
| 6,095,738 | A | 8/2000 | Selle | |
| 6,129,431 | A | 10/2000 | Hansen, Jr. et al. | |
| 6,131,347 | A | 10/2000 | Hornberger et al. | |
| 6,185,870 | B1 | 2/2001 | Mettler | |
| 6,349,907 | B1 * | 2/2002 | Hollington et al. | 248/188.4 |
| 6,407,351 | B1 * | 6/2002 | Meyer et al. | 177/238 |
| 6,640,968 | B2 | 11/2003 | Selle | |
| 6,701,570 | B2 * | 3/2004 | Henriott et al. | 16/29 |
| 7,021,221 | B2 | 4/2006 | Del Frari | |
| 7,287,732 | B2 * | 10/2007 | Balistreri | 248/188.4 |
| 2005/0232724 | A1 | 10/2005 | Selle | |

OTHER PUBLICATIONS

U.S. Appl. No. 11/444,729, Selle.
U.S. Appl. No. 11/673,525, Selle et al.

* cited by examiner

*Primary Examiner*—Ramon O Ramirez
(74) *Attorney, Agent, or Firm*—Woodling, Krost and Rust

(57) ABSTRACT

An improved leveling device for adjusting the height of a substrate with a leveling device located between the floor and the bottom of the piece of furniture. The leveling device is comprised by a threaded stud which resides in a propel nut. The threaded stud is comprised by a first end, an end cap, and a second end, a leveling surface. The leveling device is inserted into a bore in the bottom of the piece of furniture. The propel nut of the leveling device grips the bore and holds the leveling device in the bore. The oversized end cap with respect to the threaded stud and the propel nut in combination with the bore of the substrate is resistably movable and exerts a force against the bore in the substrate to counter forces exerted against the leveler by the floor when dragging the furniture.

7 Claims, 11 Drawing Sheets

LEVELING DEVICE AND METHOD FOR MAKING SAME

FIELD OF THE INVENTION

The invention is in the field of leveling devices.

BACKGROUND OF THE INVENTION

The related art leveling devices have the deficiency of poor drag and drop performance. Simply put, the related art is susceptible to damage caused by the moment created by applying a force to the foot of the leveler by moving the support structure (i.e. furniture). Support within a furniture leg via a propel nut, for example, counteracts torque applied to the foot of a leveling device. Longer propel nuts may be used to provide better support as the foot is coupled to the propel nut with a threaded stud. However, longer propel nuts are difficult and expensive to form as they are stamped from sheet steel and drawn longer and longer by a progressive die. This is difficult however due to thinning of the material and long propel nuts are difficult to tap.

FIG. 1 is a partial cross-sectional view 100 of a prior art leveler 109 attached to a wood, plywood, or pressboard substrate 101. Alternatively, levelers may be used with plastic substrates. The substrate 101 may be a furniture leg or support. The device may be, for instance, applied to industrial equipment. A propel nut 104 resides in a bore 102 of the substrate 101. The propel nut has skives 105 which engage the bore 102 of the substrate and surrounding substrate material and which assist in retaining the propel nut in the substrates. The propel nut has a flange 107 which abuts exterior surface 106 of the substrate 101. The propel nut is fixed in the substrate. The flange surface 108 engages the surface 106 of the substrate. A threaded stud 103A is threaded into the propel nut 104 and is rotatably and translationally movable with respect to the propel nut.

The threaded stud 103A includes an integral nut 109A and floor engaging surface 109B. Threads 103 extend from the nut 109A to the end of the stud. The threaded stud 103A rotates and moves translationally with respect to the internal threads of the propel nut. In this way the floor engaging surface 109B may be positioned relative to the substrate (i.e. leg of the furniture) to adjust the height of the furniture with respect to the floor. When the propel nut is installed into the substrate there is a slight rotational movement of the skives 105 and the barrel of the nut as the nut is forced into the bore 102 of the substrate 101. The height of the leveler is based on the translational movement of the threaded stud within the propel nut. Deformation 130 occurs in the substrate 101 near the surface of the propel nut as it is forced into the substrate.

FIG. 2 is a bottom view 200 of the prior art leveler in substrate 101. The wood substrate has cracks 201 in the surface 106 and distortions 210 or bowing in the plane of the wood. The cracks or other disruptions in the surface are caused by dropping or sliding the furniture. Dropping applies a force generally along the axis of the threaded stud 103A and dragging applies a force generally perpendicular to the axis of the threaded stud 103A.

Propel nuts are used in the furniture industry to secure levelers in substrates. Propel nuts are shorter than the threaded studs which are inserted inside the propel nut so that adjustments may be made. The height of the prior art leveler is changed by adjusting the threaded stud relative to the propel nut.

When extended to its full length, the leveler is especially susceptible to bending or breaking which can damage either the substrate or the entire piece of furniture. The leveler is more susceptible when fully extended because the bending moment or torque which is applied when the furniture is moved by sliding it on the floor is large. Also, the furniture may be lifted and dropped which tends to fracture the substrate 101.

Correcting a defect in an article supported and positioned by a leveler can be difficult, time consuming, labor intensive, and expensive. In some cases, the entire substrate or the furniture may have to be discarded and/or the furniture disassembled if a leg of the furniture is fractured.

Two approaches to solve the aforementioned problems involve the use of thicker side panels or longer propel nuts. Use of aforementioned thicker side panels adds to the weight of the substrate and can significantly add to the expense of the furniture produced. Longer propel nuts also contribute to increased cost in manufacturing the final piece of furniture.

Levelers for the legs or walls of furniture are also sometimes described as leveling mounts, swivel levelers, rigid levelers, adjustable feet, leveling pads, furniture glides, leg levelers, desk glides, table glides, furniture sliders, threaded T-nuts for wood legs, and low profile levelers. U.S. Pat. No. 4,991,365 to Jackson discloses a foot pad attached to a shaft portion for leveling panels in a relocatable wall. U.S. Pat. No. 6,129,431 to Hansen Jr. et al discloses the use of a built-in riser in the base of a wall section. U.S. Pat. No. 4,770,275 discloses the use of a riser in an adjustable ladder assembly. U.S. Pat. No. 5,138,814 to Giles et al. discloses the use of a nut-and-bolt type leveler consisting of a threaded bolt portion which cooperates with a nut against a washer to extend or retract a foot.

The structure of the instant invention and the advantages its provides will be readily apparent to a person of ordinary skill in the art when reference is made to the Summary of the Invention, Brief Description of the Drawings, Description of the Invention and Claims which follow hereinbelow.

SUMMARY OF THE INVENTION

A leveling device is disclosed and claimed which exhibits superior drag performance. An end cap is pressed onto an end of the threaded stud which is used in combination with a propel nut and a bore in the substrate. In this way, the effective length of the propel nut in the bore and the effective arm length is extended which counteracts a drag force applied to the foot of the device which engages the floor or the mounting surface. The end cap snugly fits within the bore of the substrate providing support while enabling rotational and translational movement of the threaded stud with respect to the propel nut.

Use of the device enables larger adjustment ranges through the use of longer threaded studs while providing improved performance in regard to drag tests.

A leveling device for leveling furniture includes a propel nut and threaded stud in a bore of a substrate. The threaded stud includes a nut for rotating the stud, a leveling surface for engaging the floor or other surfaces, and an end cap secured to the end of the stud. The distal (with respect to the foot) threaded stud includes a first end (top end) and a second end (bottom end). The top end is cylindrically shaped. The bottom includes a foot and an integral nut. The propel nut includes a flange which abuts on the outer surface of the substrate and skives which grip the bore.

The first end of the threaded stud is not threaded and passes through the propel nut when the treaded portion of the threaded stud interengages the propel nut. Then an end cap is pressed on the top end. The bottom end of the threaded stud contains a nut and a leveling surface.

Once assembled the leveling device is fit into the bore of a substrate by forcefully pressing the propel nut with skives on its barrel into the bore. The diameter of the cylindrical end of stud with the end cap pressed thereon is greater than the diameter of the threaded stud and at least as large as the diameter of the propel nut 104. As a result, the end cap snugly engages the bore of the substrate when forced into the bore. The end cap is rotationally and translationally movable within the bore, so that the leveler and the threaded stud may be repositioned.

However, the end cap has a translational movement limitation. The end cap can not move past the top end of the propel nut, thus preventing the extraction of the threaded stud and foot. The nut surface 109C can not move beyond the top end of the bore 102. The end cap has a snug fit within the bore which prevents movement of the threaded stud.

The range of movement of the threaded stud is limited by the end cap as far as extension of the stud is concerned. Further, the range of movement of the threaded stud as far as the minimum extension is concerned is limited by the nut of the stud engaging the flange of the propel nut. The snug fit of the end cap in the bore prevents non-axial movement of the threaded stud and this then increases the stability and strength of the leveling device and improves its resistance to drag. One end (the lower end) of the end cap engages the propel nut and prevents the threaded stud from being removed and thus defines the maximum extension of the threaded stud. The end cap adds strength to the leveling system and helps prevent splitting of side panels if the furniture is dropped and especially if the furniture is dropped such that the foot strikes the floor at an angle. The threaded stud can not be removed or overextended from the leveling device. As a result, stability of the leveler is significantly increased.

Use of the device allows adjustability between a first full extended position of the stud and foot of the leveler and a second fully inserted position of the stud and foot of the leveler.

A method for forming and using the leveling device is disclosed and claimed. The method includes the steps of: threading a threaded stud into a propel nut, forming an end cap on a first end of the threaded stud, inserting and pressing the propel nut and end cap of the threaded stud into the bore of the substrate. Adjusting the leveling surface of the threaded stud is accomplished by turning the nut attached to the second of the threaded stud until the desired position is achieved.

It is an object of the instant invention to provide a leveling device which includes a propel nut, a threaded stud, and an end cap mounted on the threaded stud.

It is an object of the instant invention to provide a stable height adjustment device for a substrate containing a bore.

It is an object of the instant invention to provide level adjustment using an end cap on a threaded stud press fit within a bore in which the end cap has a diameter greater than the threaded stud.

It is an object of the instant invention to provide level adjustment of a substrate with a threaded stud in which one end contains a level adjustment surface and the other end of the threaded stud has a end cap which resides in a bore of the substrate.

It is an object of the instant invention to provide a method for forming a leveling device having a threaded stud, end cap, and propel nut.

It is an object of the instant invention to provide a leveling device which has superior drag resistance.

It is an object of the instant invention to provide a leveling device which is able to absorb a large bending moment which is created when the furniture in which it is installed is dragged along a floor to a new position.

It is an object of the instant invention to provide a leveling device which counteracts a large bending moment through the use of an end cap on the threaded stud.

It is an object of the present invention to provide a leveling device which may be installed for use and then shipped with the threaded stud retained therein.

It is an object of the invention to enable use of longer threaded studs which provide a greater range of height adjustment due to increased stability of the device.

It is an object of the present invention to obtain the functionality of a long propel nut using the end cap and a shorter propel nut.

These and other objects of the invention will be best understood when reference is made to the Brief Description Of The Drawings and Claims which follow hereinbelow.

The drawings will be best understood when reference is made to the Description of the Invention and Claims below.

DESCRIPTION OF THE INVENTION

Figure 1:
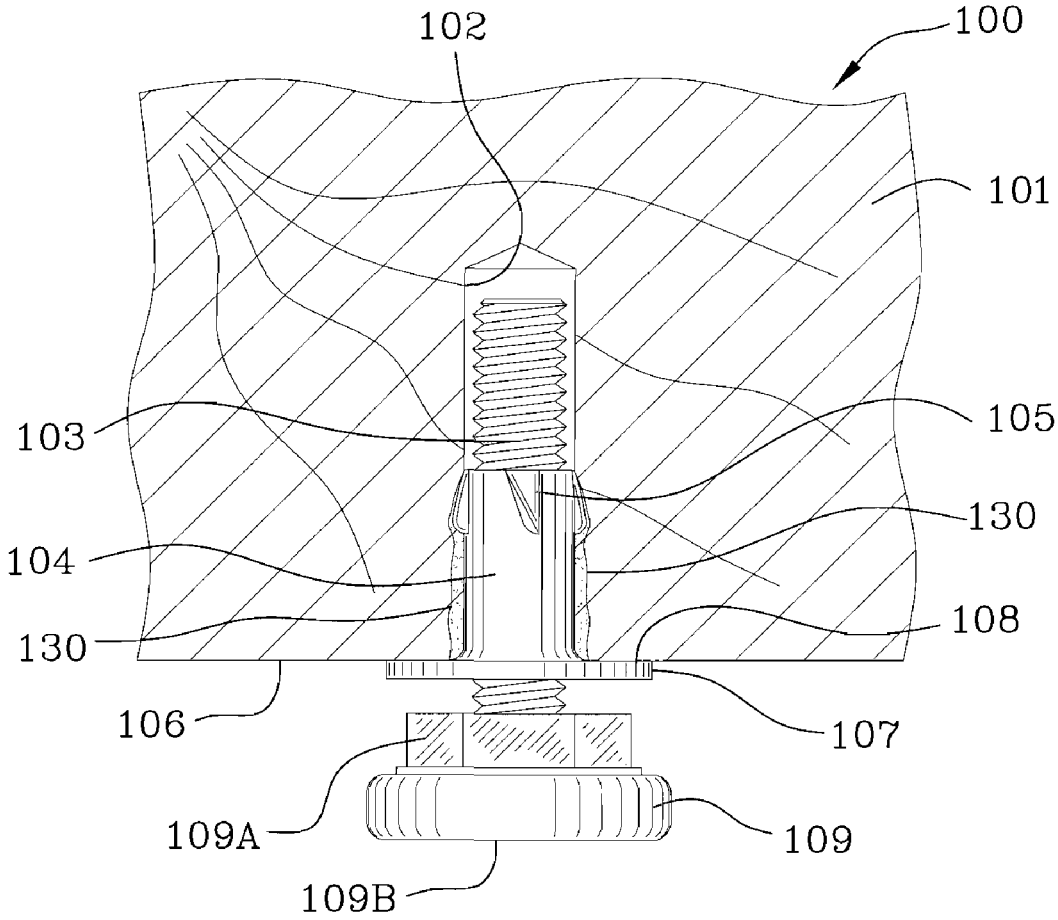
FIG. 1 (PRIOR ART)
FIG. 1 is a partial cross-sectional view of a prior art leveler inserted and secured to a wood, plywood, or press board substrate.
Figure 2:
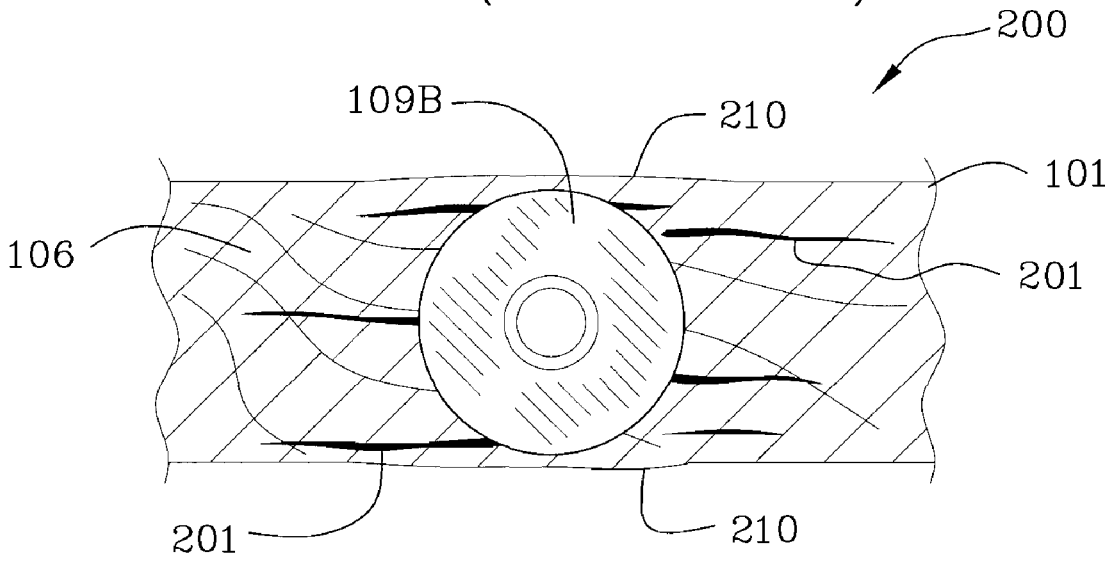
FIG. 2 (PRIOR ART)
FIG. 2 is a bottom view of the prior art leveler of FIG. 1.

FIGS. 1-2 have been described above in connection with the Background of the Invention.

Figure 3:
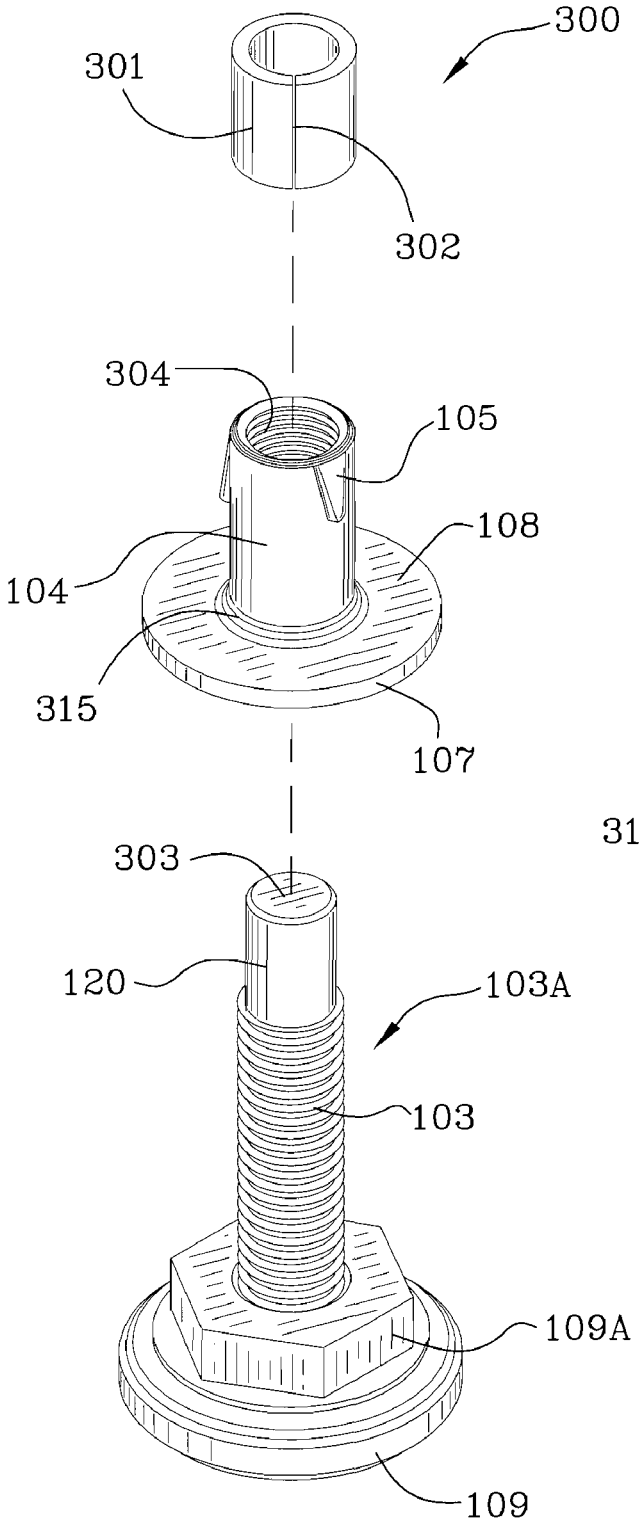
FIG. 3 is an exploded assembly view of the rolled end cap, propel nut, and threaded stud.

FIG. 3 is an exploded assembly view 300 of the rolled end cap 301, propel nut 104, and threaded stud 103A. The rolled end cap 301 has a seam 302. Propel nut 104 has internal threads 304, a plurality of skives 105, and a flange 107. Flange 107 has a contact or engagement surface 108 for interengaging the substrate. See FIGS. 6B-6D. Threaded stud 103A has a cylindrical end 120, an end 303, a nut 109A, and a leveler 109. It is specifically contemplated that levelers having a shape other than that described and shown in the drawings may be used. The cylindrical end 120 terminates in surface end 303 of the threaded stud as viewed in FIG. 3. The diameter of the cylindrical end 120 is less than the diameter of threads 103 of the stud 103A. Cylindrical end 120 of the stud 103A is not threaded. The threaded stud is threaded from the nut 109A to the cylindrical end 120. The nut 109A is part of the threaded stud adjacent to the leveler and has a hexagonal shape. Leveler 109 is disk shaped, has a diameter greater than nut 109A, and is located on the bottom of the threaded stud. The leveler has a bottom surface 109B which engages the mounting surface such as a floor. See FIG. 3C.

Figure 3A:
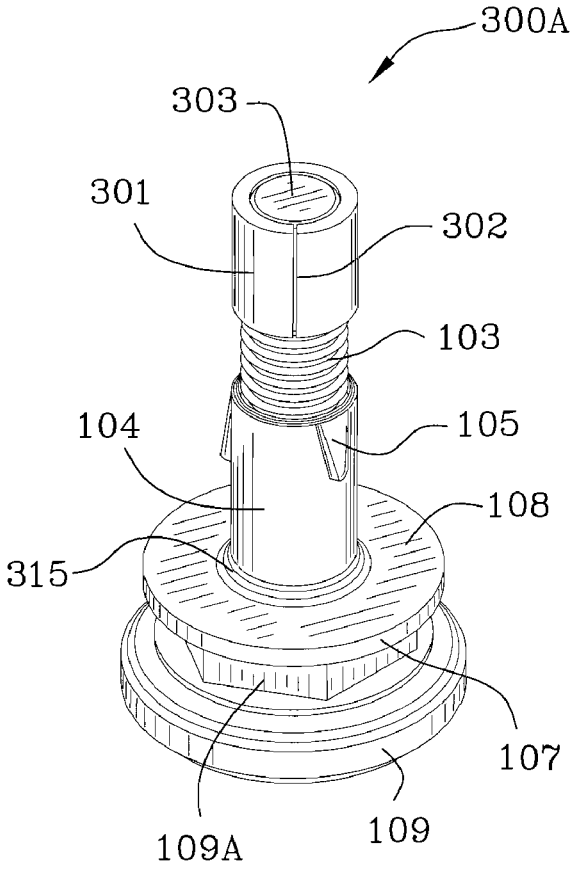
FIG. 3A is an assembled view of the end cap, threaded stud, and propel nut.

FIG. 3A is an assembled view 300A of the end cap 301, threaded stud 103A, and propel nut 104. Threads 103 extend from the nut 109A to the cylindrical end 120 of the stud 103A. End cap 301 is pressed onto the cylindrical end of stud 120. End 303 is exposed at the top of the threaded stud. The threaded stud 103A is threaded into the propel nut 104. Flange 107 of the propel nut 104 is shown engaging nut 109A in FIG. 3A. Nut 109A is integral with leveler 109. Leveler 109 is located at the bottom of the threaded stud 103A and is integral therewith.

Figure 3B:
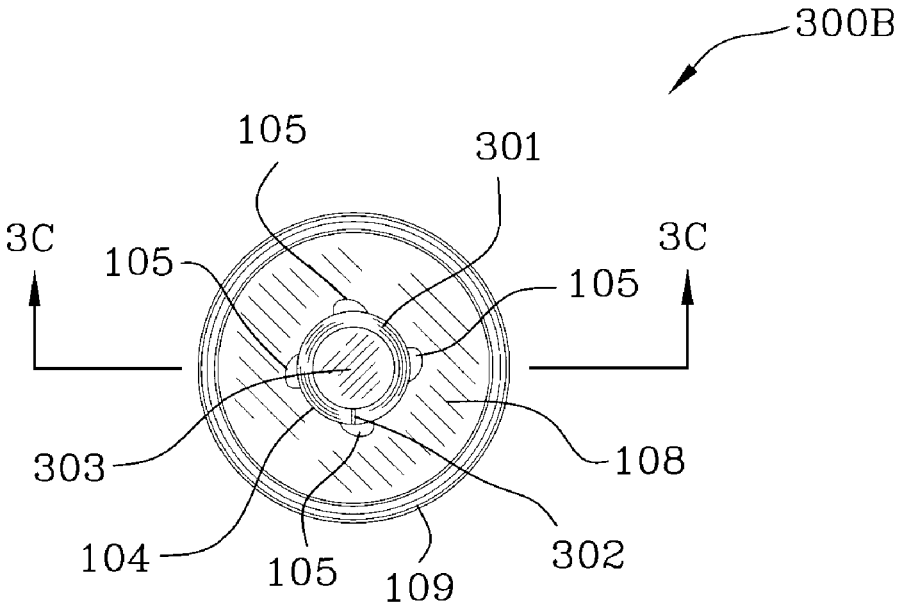
FIG. 3B is a top view of the threaded stud of FIG. 3A.

FIG. 3B is a top view 300B of the assembled leveling device. The end 303 of the threaded stud is viewed in FIG. 3B. Rolled end cap 301 is located on the outer circumference of the cylindrical end 120. Propel nut 104 is threadedly interconnected to threads 103 of stud 103A. The position of the stud 103A may be adjusted by rotating the threaded stud within the propel nut. Skives 105 are located around the circumference or barrel of the propel nut 104. Surface 108 of the flange 107 of the propel nut 104 interengages the surface of the device into which it is installed. See FIGS. 6B-D. The diameter of the leveler 109 is greater than the diameter of the flange 107 of the propel nut 104.

Figure 3C:
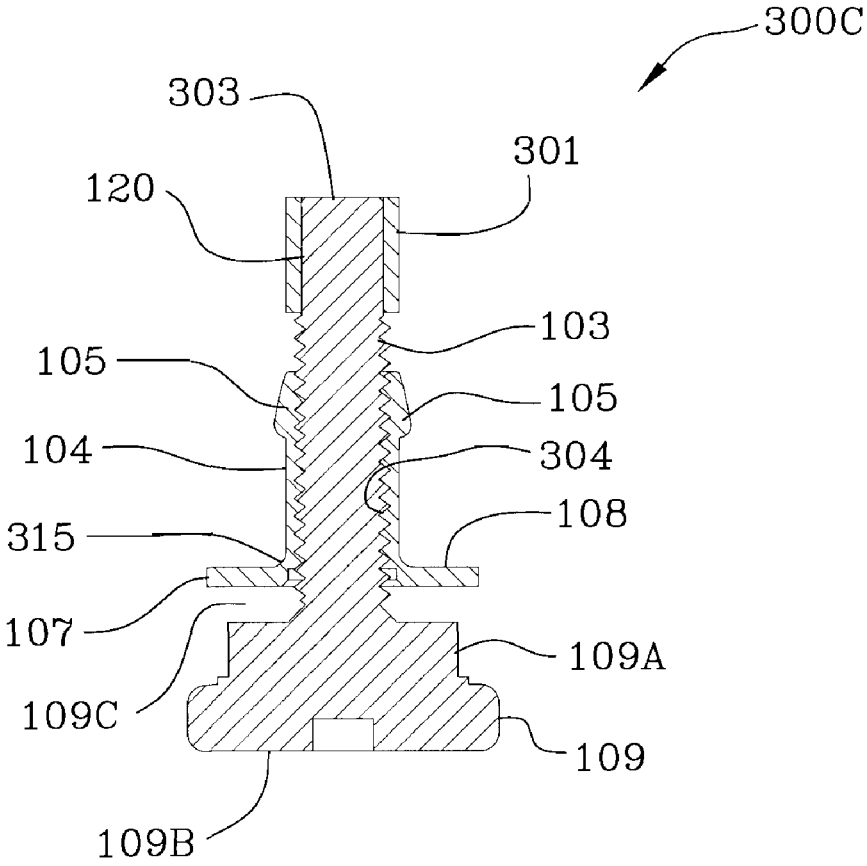
FIG. 3C is a cross-sectional view taken along the lines 3C-3C of FIG. 3B of the threaded stud and propel nut assembly.

FIG. 3C is a cross-sectional view 300C taken along the lines 3C-3C of FIG. 3B of the threaded stud 103A and propel nut 104 assembly. End 303 of the threaded stud 103A and rolled end cap 301 are viewed in FIG. 3C. Rolled end cap 301 surrounds cylinder 120 and seam 302 is viewed therebetween. The internal threads 304 of the propel nut 104 are shown threadedly interengaging the threaded stud 103A which extends therethrough. Skives 105 are located on the outer surface of the propel nut. The contact surface 108 of the flange 107 of the propel nut 104 is located above the leveler 109. There are a few threads of the threaded stud shown in between the flange 107 and the top surface 109 of the nut 109A on the threaded stud. The nut is located directly on top of the leveler 109 and is integral therewith. The outer diameter of the leveler is slightly larger than the diameter of the flange of the propel nut. The surface of the leveler 109B is located at the bottom of the assembly and engages the floor.

Figure 4:
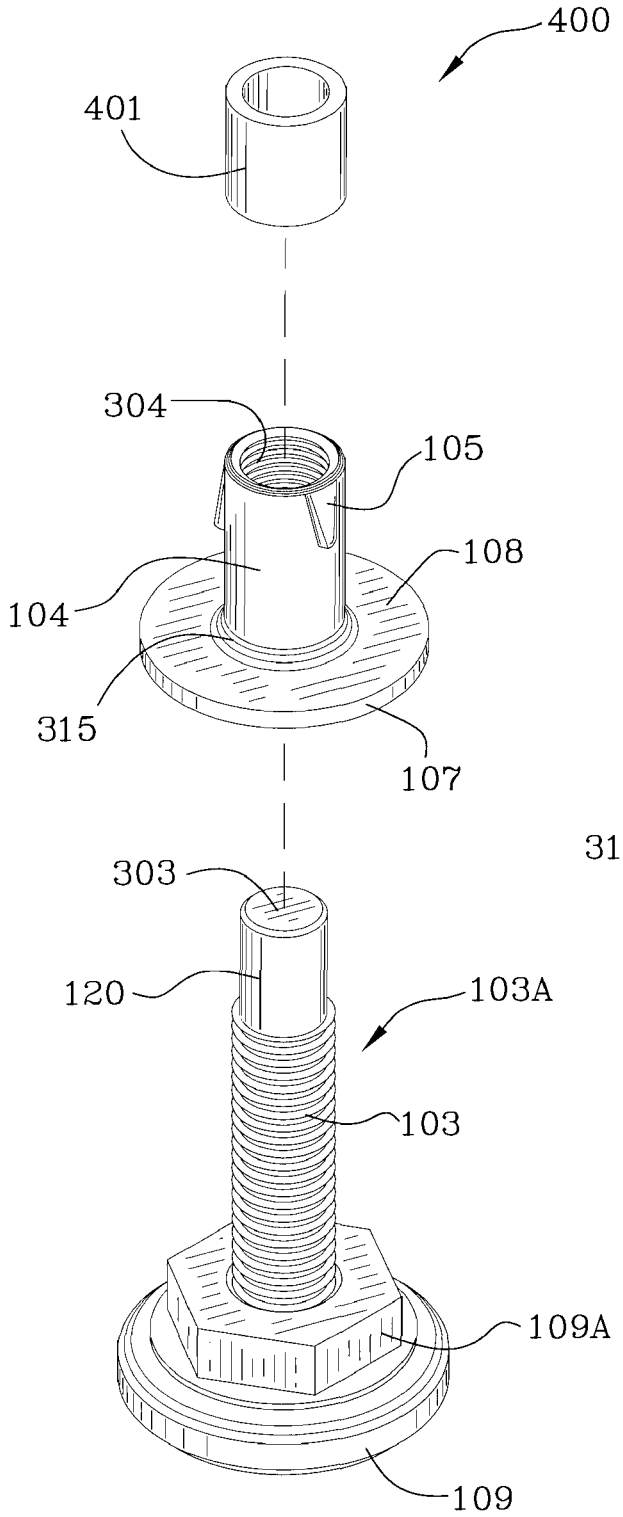
FIG. 4 is an exploded assembly view of the improved leveling device.

FIG. 4 is an exploded assembly view 400 of the improved leveling device. Press fit end cap 401 is fitted over the cylindrical end 120 of the threaded stud. A larger diameter end cap may be used and will result in a tighter fit in bore 102 making rotational and translational movement of the stud 103A more difficult but still possible. The press fit end cap has an internal and external radius. The external radius is roughly equivalent to the outer radius of the shaft of the propel nut which lies beneath the end cap.

Internal threads 304 line the inside of the propel nut 104. Skives 105 are located on the upper part of the outer shaft (barrel) of the propel nut 104. The cylindrical end 120 is not threaded and receives the press fit end cap. The threaded stud 103A has a threaded area extending from after the cylindrical end 120 to nut 109A. Nut 109A has a hexagonal shape and is integral with the threaded stud 103A which is integral with the leveler 109.

Leveler 109 is disk shaped with a diameter greater than the nut 109A, flange 107 of propel nut, shaft (barrel) of the propel nut, and end cap 301/401.

Figure 4A:
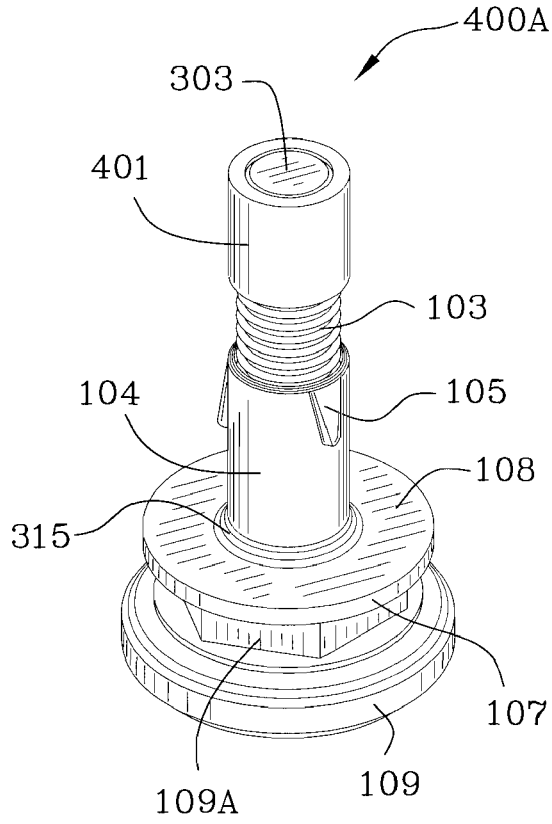
FIG. 4A is an assembled view of the improved leveling device.

FIG. 4A is an assembled view 400A of the improved leveling device. The end cap 401 is press fit over the cylindrical end 120 of the threaded stud 103A. Threads 103 are located intermediate end cap 401 and nut 109A of the threaded stud. The propel nut is threaded onto the threaded stud. The flange 107 of the propel nut is shown abutting nut 109A of the threaded stud 103A.

Figure 5:
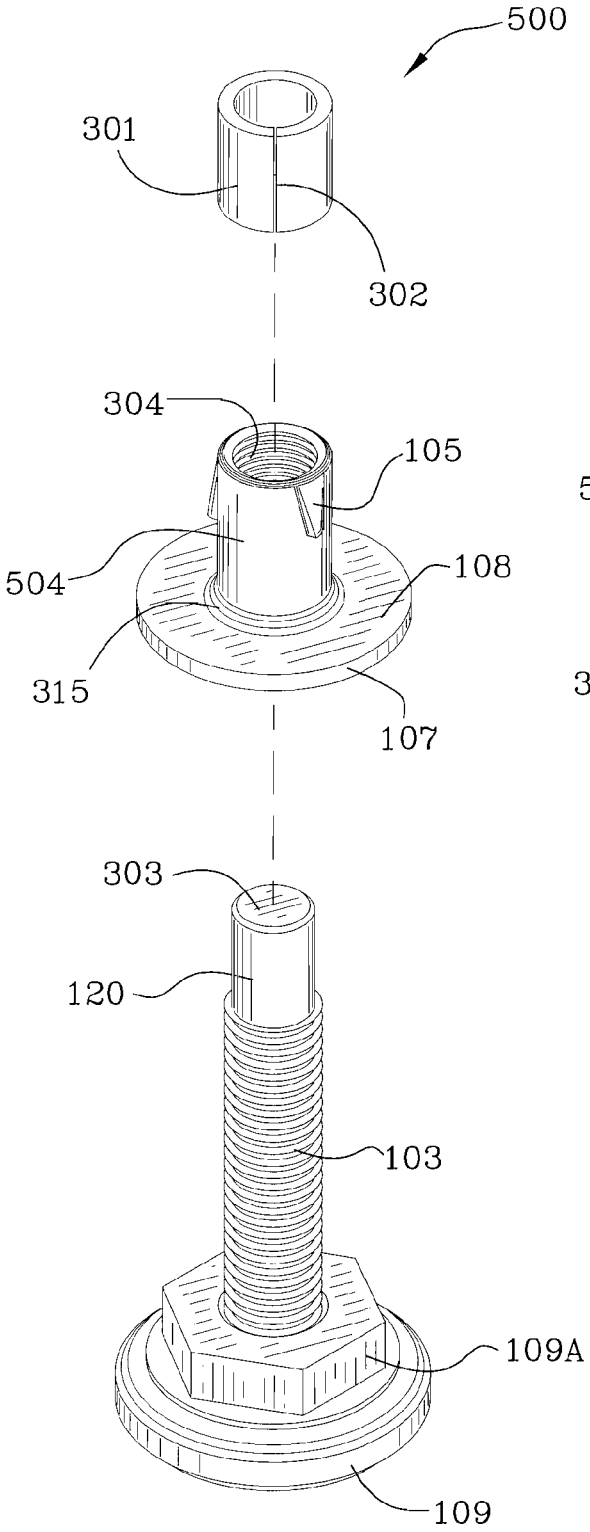
FIG. 5 is exploded assembly view of the improved leveling device with a rolled end cap.
Figure 5A:
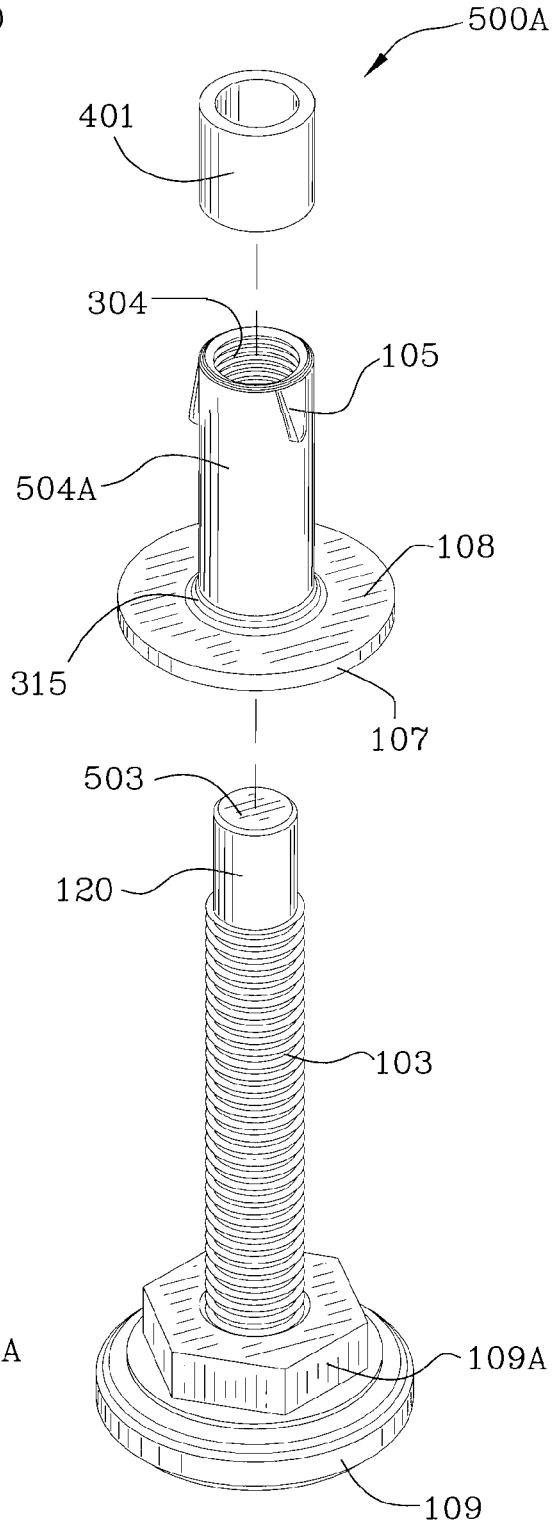
FIG. 5A is exploded assembly view of the improved leveling device with a press fit end cap.

FIG. 5 is an exploded assembly view 500 of the improved leveling device with a rolled end cap 301. FIG. 5A is an exploded assembly view 500A of the improved leveling device with a press fit end cap 401. FIGS. 5 and 5A illustrate different stud lengths, different propel nuts, 504, 504A with different lengths, and different end caps 301,401. Additionally, it will be noticed that the stud lengths and propel nut lengths of FIGS. 5 and 5A are longer than those shown in FIG. 3.

Figure 6:
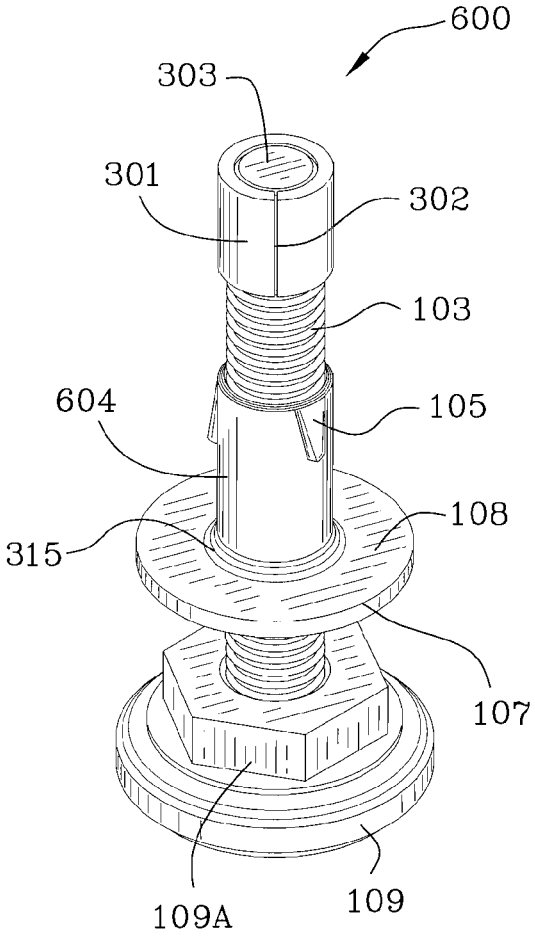
FIG. 6 is perspective view of the assembled leveling device which uses a longer the threaded stud.

FIG. 6 is perspective view 600 of the assembled leveling device with a longer threaded stud 103A. The threaded stud in FIG. 6 is longer than the threaded stud in the leveling device of FIG. 4A or the leveling device in the Prior Art in F*ig*. 1. A greater range of level adjustments that can achieved with the improved leveling device of FIG. 6 because of the support of the end cap within the bore 102.

Figure 6A:
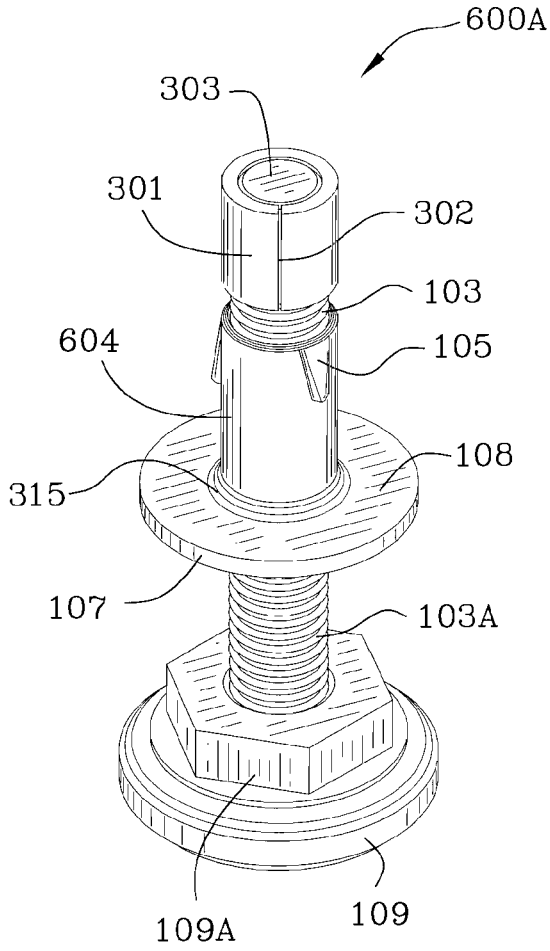
FIG. 6A is perspective view of the assembled leveling device of FIG. 6.

FIG. 6A is perspective view 600A of the assembled leveling device employing a longer threaded stud 103A as in FIG. 6. Rolled end cap 301 is wrapped around and secured to cylindrical end of stud 120 as in FIGS. 4A and 6. Propel nut 604 is illustrated closer to the top of the threaded stud 103A showing an adjustment in the position of the propel nut from its position in FIG. 6. Propel nut 604 is fixed in the substrate and the threaded stud is moved relative thereto. Threaded stud 103A is adjustable in a plurality of positions with respect to the propel nut. The rolled end cap 301 at the end of threaded stud does not allow the threaded stud to move past the point where the bottom of the end cap 301 and the top of the propel nut 104 engage preventing complete extraction of the threaded stud. Threaded stud 103A is limited in its translational positions with respect to the propel nut in that the rolled end cap 301 abuts against the top of the propel nut 604 or the nut 109A engages against the flange 107.

Figure 6B:
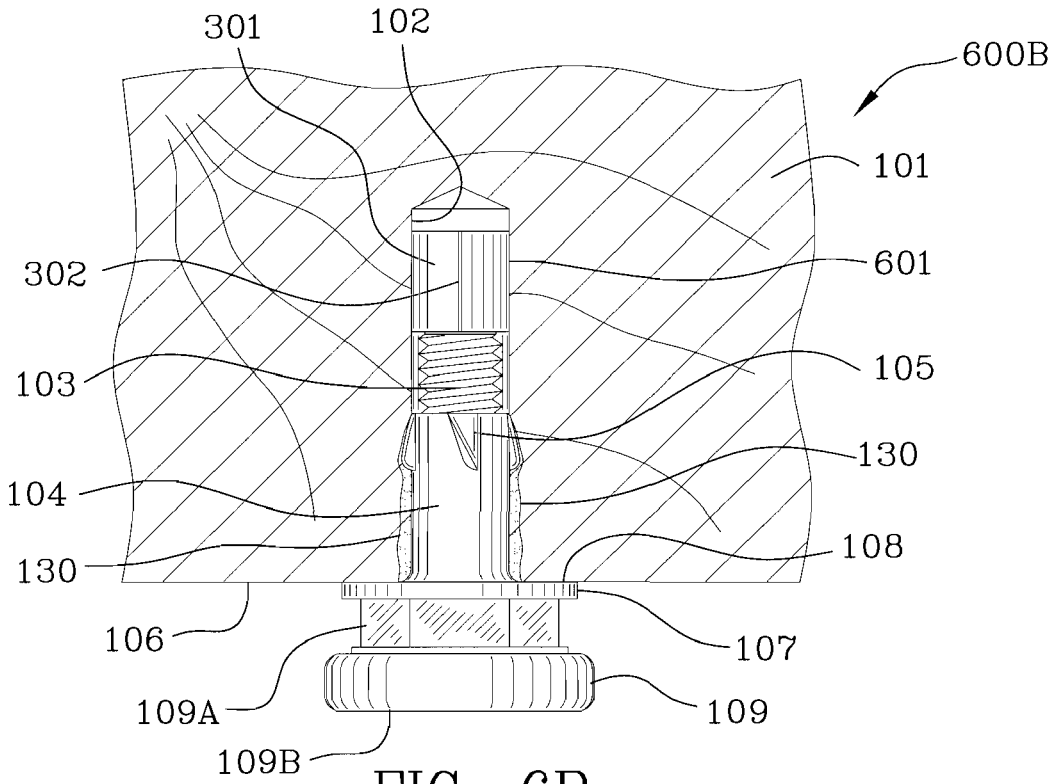
FIG. 6B is a partial cross-sectional view of the assembled leveling device employing a long threaded stud completely inserted into the base of a substrate.

FIG. 6B is a perspective view 600B of the threaded stud 103A inserted into the bore 102 of a substrate 101. The assembled leveling device uses a threaded stud 103A. Rolled end cap 301 is located near the top of the bore 102 and this represents the fully inserted position of the foot 109. The outer surface of the rolled end cap engages the bore 102 as indicated by reference numeral 601. Propel nut 104 is fixed in position in the bore 102 of the substrate 101. Skives 105 are illustrated as embedded into the substrate 101. Slight deformation of the wood 130 is observed in the vicinity of the substrate 101 intermediate the shaft of the propel nut 104 and the bore 102 of the substrate 101. Flange 107 of the propel nut abuts bottom surface 106 of the substrate 101. The top of the nut 109A abuts flange 107 of the propel nut 104, Leveler 109 is integral with nut 109A and bottom surface 109B rests upon a surface (not shown).

The threaded stud is able to move in an up and down translational direction by rotating the nut 109A which enables the threaded stud to move relative to propel nut 104. The movement of the threaded stud 103A with respect to the propel nut is limited by the position of the nut 109A on the outside of the bore 102 and the position of the end cap 301 in the bore 102 of the substrate 101.

End cap 301 is diametrically larger than the threaded stud 103A. End cap 301 has a snug fit within bore 102 and is rotationally movable as the end cap 301 passes along the cylindrical bore 102 when the threaded stud 103A rotates with respect to the interior threads of the propel nut 104. The height of the substrate and leveling device is adjustable based on the length of the threads 103 of the threaded stud 103A. As shown in FIG. 6B, the leveler is illustrated in a second position fully inserted into and through the propel nut. This second position provides the shortest possible leg height adjustment. At the lowest height adjustment position of the leveling device, the length of the threaded stud within the bore 102 of the substrate is at its maximum and this is referred to herein as the first position of the leveler. The leveler, which may be longer using the end cap, is fully adjustable in a range of positions between the first and second positions.

Figure 6C:
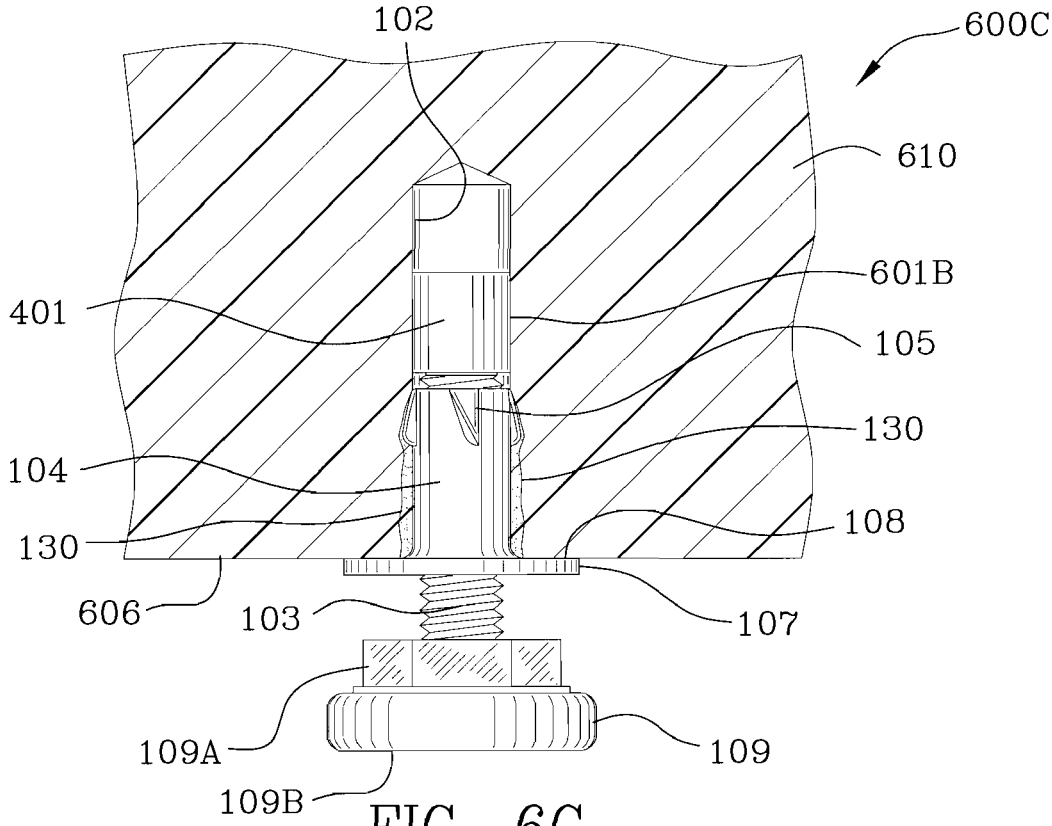
FIG. 6C is partial cross-sectional view similar to FIG. 6B with the threaded stud just about completely retracted.

FIG. 6C is partial cross-sectional view 600C of the threaded stud 103A and propel nut 104 inserted into the plastic substrate 610. In comparison to FIG. 6B, another height adjustment of the leveling device is shown in FIG. 6C. Rotating nut 109A, adjusts the length of the threaded stud 103A which extends into and out of the bore 102 of the substrate 101. Adjustment of the nut 109A enables different lengths of the threaded stud 103A to extend beyond the bottom surface of the substrate 106. In FIG. 6C, the leveling device has been adjusted by rotating the nut so as to provide a different height adjustment with respect to the substrate. In this view, it can be seen that the height of the leveling device is limited at the point where the bottom of the end cap 301 engages propel nut 104. The height of the leveling device will reach its maximum when the bottom of end cap 401 abuts the propel nut 104. At the maximum height of the leveling device and hence the device it supports, the length of the threaded stud 103A within the bore of the substrate will be at its minimum. Reference numeral 601B represents support of the bore on the end cap 601B.

Figure 6D:
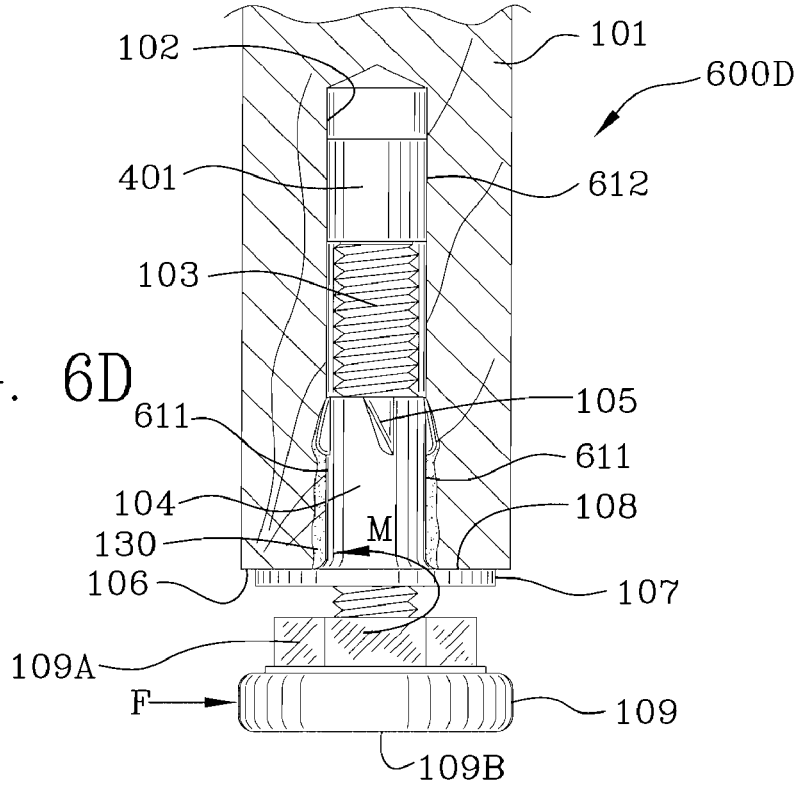
FIG. 6D is a partial cross-section view of the assembled leveling device where a drag force is applied perpendicularly to the foot of the assembled device in a state of adjustment.

FIG. 6D is a partial cross-sectional view 600D of the leveling device having a threaded stud 103A where a force F is applied perpendicularly to the orientation of the threaded stud 103A and bore 102. The threaded stud 103A illustrated in FIG. 6D has an increased length. Bore 102 counters the applied force by reacting against the propel nut as indicated by reference numeral 611. Skives 105 on propel nut grip the bore 102. End cap 401 engages bore 102 as indicated by reference numeral 612. Put another way, the exterior of the cylindrical barrel of propel nut 104 engages the bore 102 as indicated by numeral 611. The invention enables the use of a longer threaded stud 103A which provides a greater range of height adjustment and also stabilizes the leveling device in response to the force F applied to the leveler 109. Additionally, moment M is absorbed by the engagement of the flange surface 108 with the substrate surface 106, the engagement of the propel nut 104 with bore 102 as indicated by reference numeral 611, and the engagement of end cap 401 with bore 102 as indicated by reference numeral 612.

Figure 6E:
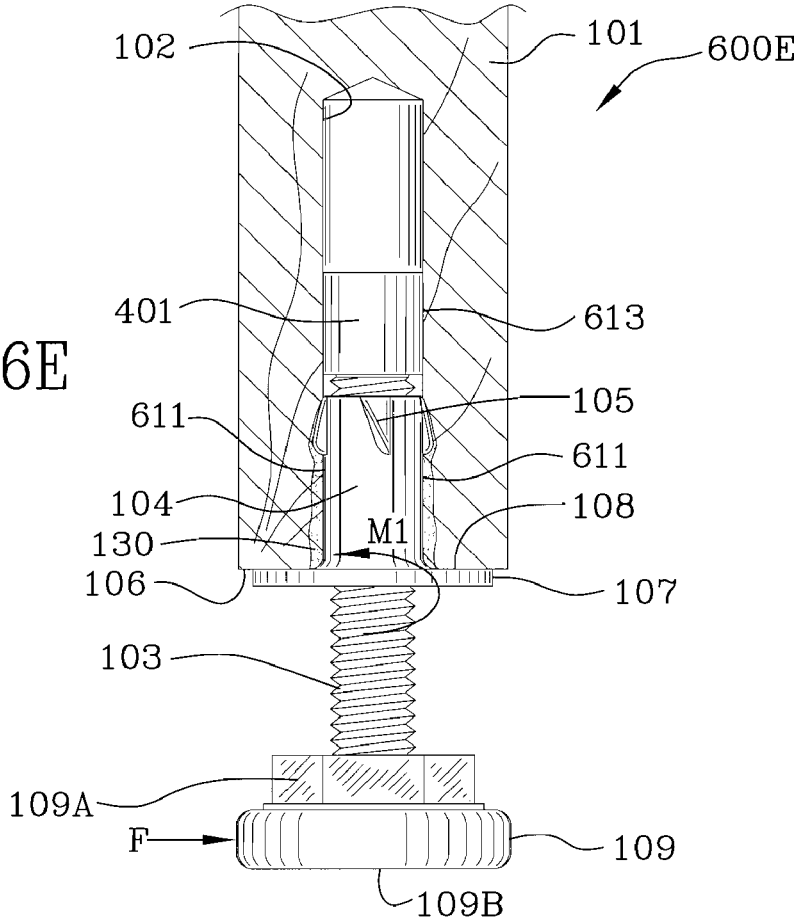
FIG. 6E is a partial cross-section view of the assembled leveling device where a drag force is applied perpendicularly to the foot of the assembled device in another state of adjustment.

FIG. 6E is a partial cross-sectional view 600E of the leveling device having a long threaded stud 103A where a force F is applied to the foot 109. FIG. 6E illustrates the stud adjusted so as to provide a different height for the substrate (i.e. a furniture leg). In this way position, the moment M1 will be larger than the moment M for the position of the FIG. 6D given the same force because the foot 109 has been rotated out of the propel nut 104 and the moment is larger since the force F is applied through a longer radius since the foot has been rotatably moved and translated downwardly.

Still referring to FIG. 6E, long threaded stud 103A is adjusted to a level position where a significant section of the threaded stud 103A extends outside the bore 102 past the bottom surface of the substrate 106. In this position, the leveling device including the threaded nut and the substrate has a greater height. A force F is applied to the leveler. This applied force is counteracted by the end cap 401 and propel nut 104 reacting against bore 102. Reference numerals 611 and 613 indicate the counteraction of the bore 102 against the propel nut 104 and end cap 401 respectively.

Skives 105 on propel nut grip bore 102. The bore 102 counters the applied force by supporting the propel nut 104 as indicated by reference numeral 611. End cap 401 engages bore 102 as indicated by reference numeral 613. The exterior of the cylindrical barrel of propel nut 104 engages the bore 102 as indicated by numeral 611.

The invention enables the use of a longer threaded stud 103A which provides a greater range of adjustment and also stabilizes the leveling device in response to the force F applied to the leveler 109. Additionally, the moment M1 is absorbed by the engagement of the flange surface 108 and the substrate surface 106.

Figure 7A:
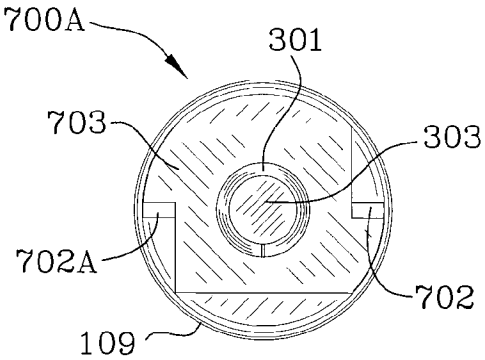
FIG. 7A is a top view of FIG. 7.
Figure 7C:
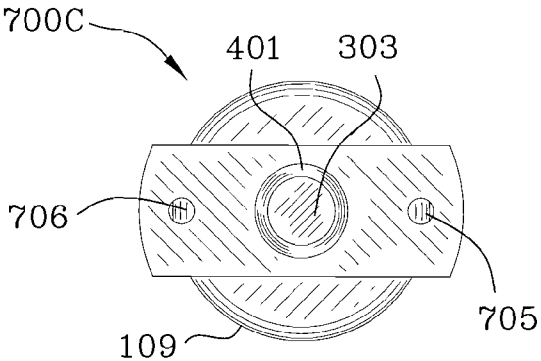
FIG. 7C is a top view of FIG. 7B.
Figure 7E:
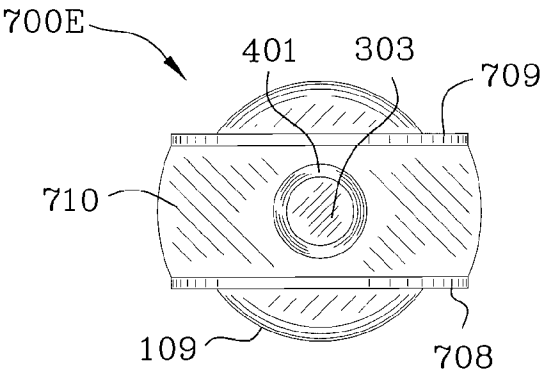
FIG. 7E is a top view of FIG. 7D.
Figure 7:
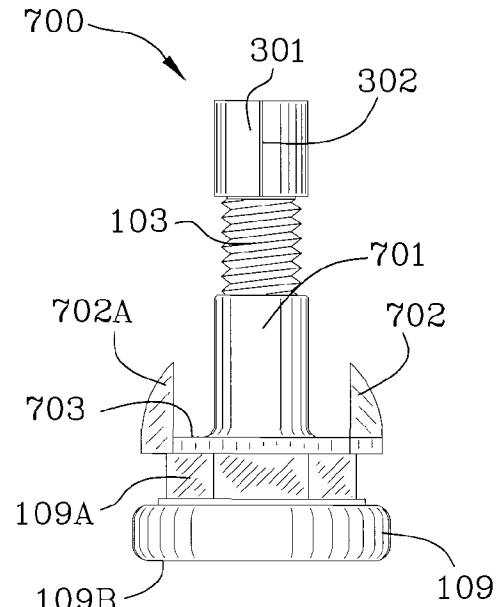
FIG. 7 is a side view of another example of the leveling device.

FIG. 7 is a side view 700 of another example of a leveling device. The slab base 2 prong tee nut 701 has a flange 703 with upwardly pointed prongs 702A and 702 commonly used on the T-nuts.

FIG. 7A is a top view 700A of FIG. 7. Intermediate rolled end cap 301 and leveler 109 is flange 703 of a tee nut used in place of a propel nut. Flange 703 includes straight edges in a generally rectangular shape with ends of the flange forming prongs 702, 702A.

Figure 7B:
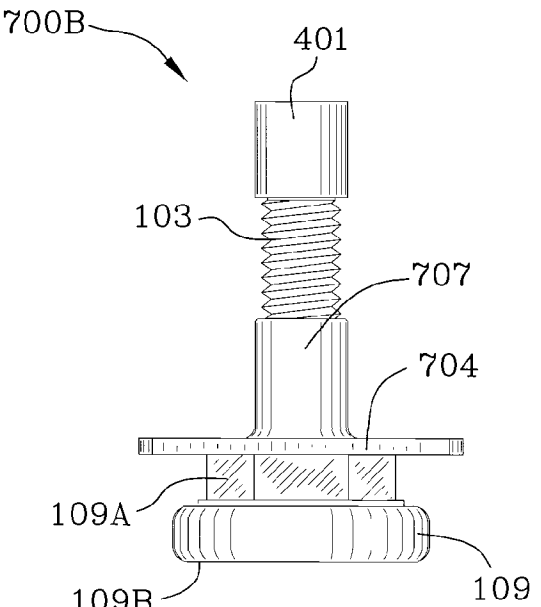
FIG. 7B is a side view of another example of the leveling device.

FIG. 7B is a side view 700B of another example of the leveling device. A press fit end cap 401 is located at the top of the threaded stud 103A. A slab base two hole tee nut 707 has a generally rectangularly shaped flange 704 with long straight edges on opposite sides. Tee nut 707 includes apertures for tacking the tee nut to a substrate. The flange 704 of the tee nut extends past the leveler 109 horizontally on both sides. Each of the straight edges of the flange 704 are connected with a rounded arc on each end.

FIG. 7C is a top view 700C of FIG. 7B. From this view, flange 704 is seen to have a generally rectangular profile with rounded arcs on the shorter ends. Apertures 705 and 706 are located in the flange on opposites of the flange 704. Flange 704 has two longer straight edges with rounded edges on the shorter sides. The straight line edges of the flange 704 extend past the circular profile of the leveler 109 which is located underneath the flange 704.

Figure 7D:
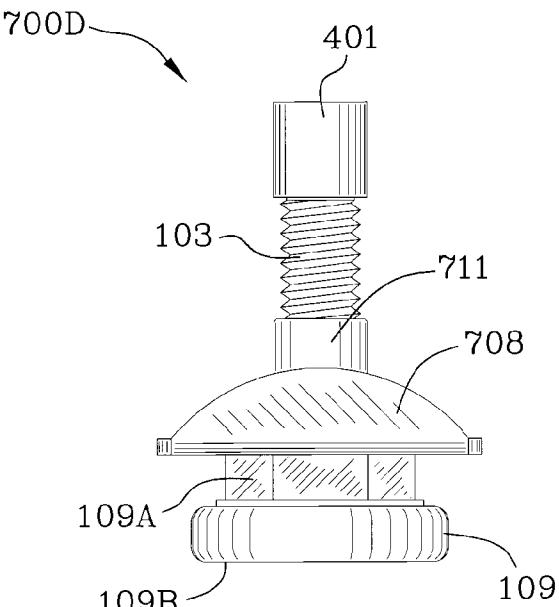
FIG. 7D is a side view of another example of the leveling device.

FIG. 7D is side view 700D of another example of the leveling device. Slab base two tab tee nut 711 has arc shaped wings 708, 709 that extend in an upward direction 708, 709 much like a napkin holder. The arc shaped wings of the flange 710 extend in a horizontal direction past the nut 109A and the leveler 109.

FIG. 7E is a top view 700E of FIG. 7D. Flange 710 is seen to have a generally rectangular shaped profile with the extended wings 708, 709 on flange 710 seen as long straight sides with shorter arc shaped edges at both ends in this view. The extended wings 708, 709 extend past the outer circumference of the leveler 109.

Figure 8:
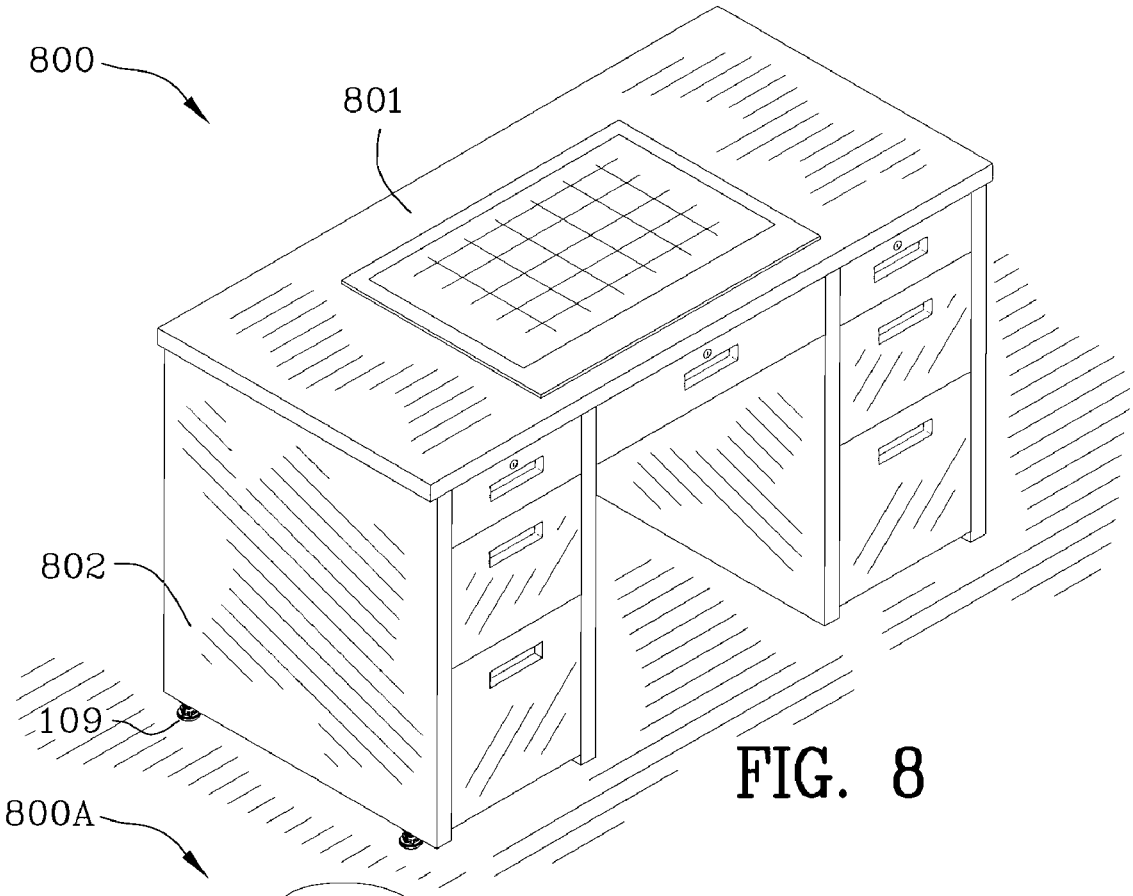
FIG. 8 is a perspective view of a desk with a leveler attached to the bottom of a side wall of the desk.

FIG. 8 is a perspective view 800 of a desk 801 with a leveler 109 attached to the bottom of a side wall 802 of the desk.

Figure 8A:
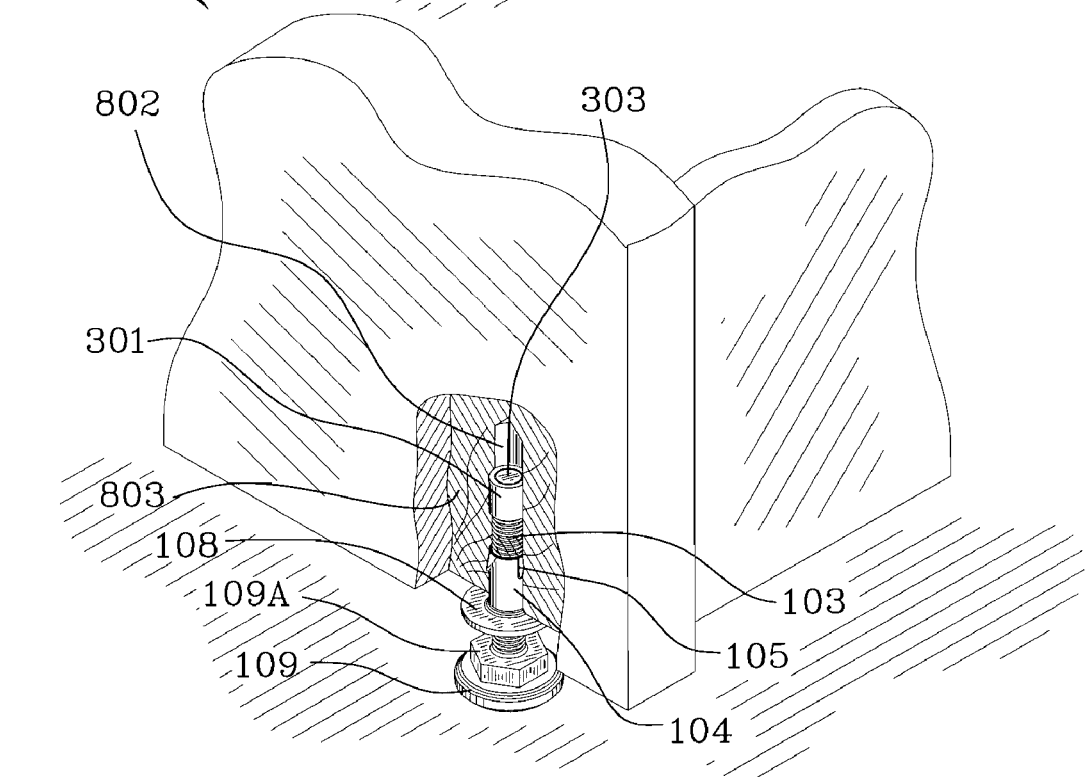
FIG. 8A is an enlarged cut-away perspective view of the assembled leveling device mounted in the side wall of the desk in FIG. 8.

FIG. 8A is a cut-out perspective view of the leveler 109 attached to the bottom of side wall 802 of the desk 801 in FIG. 8. The threaded stud 103A is located in a bore 102 in the side wall 802 with end cap 301 located at the top of the threaded stud 103A near the top of the bore 102. The propel nut 804 is located in the bore 102 and interengages the threaded stud 103A. Skive 105 of the propel nut engages the bore 102. Contact surface 108 of the flange of the propel nut engages the bottom of side wall 802.

Figure 8B:
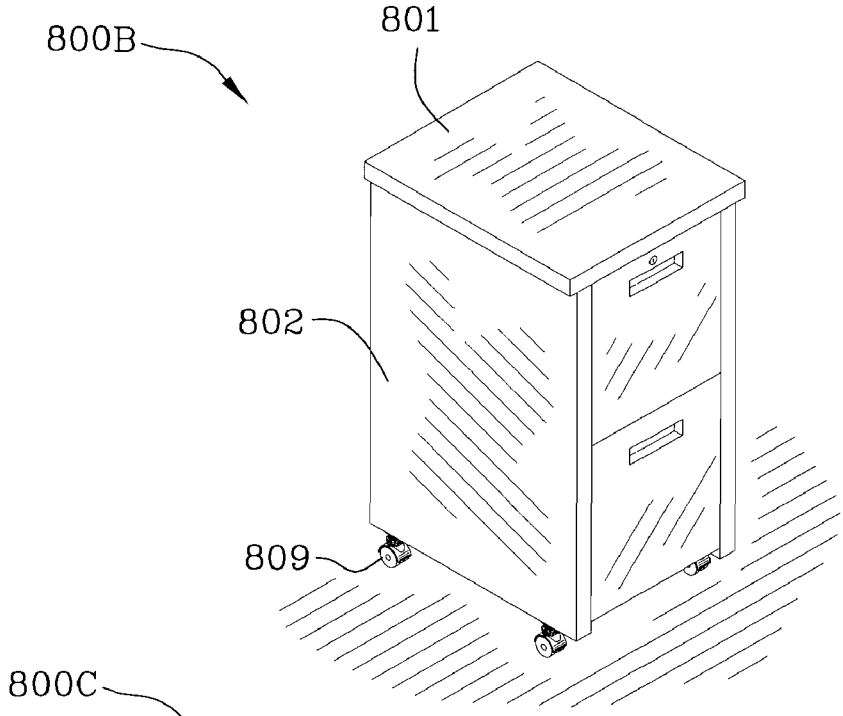
FIG. 8B is a perspective view of a piece of furniture.

FIG. 8B is a perspective view 800B of a piece of furniture 801. Roller 809 is located on the bottom of the side wall 802.

Figure 8C:
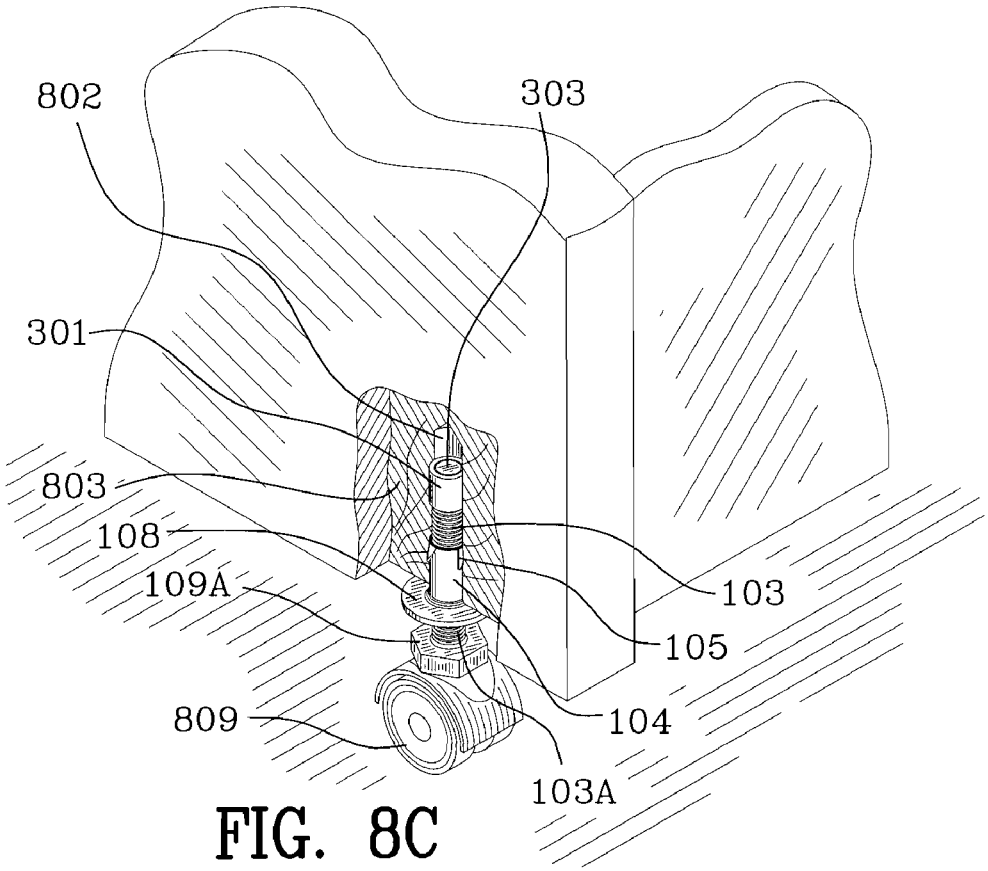
FIG. 8C is an enlarged cut-away similar to FIG. 8B.

FIG. 8C is an enlarged cut-away view 800C from FIG. 8B. Threaded stud 103A is located in a bore 102 in the cutout 803 of the file cabinet. The outer surface of the top end of the thread stud 303 is located near the top of the bore 102. Rolled end cap 301 on the cylindrical end of the threaded stud has a snug fit within the bore 102. Propel nut is located on the threaded stud with skive 105 of the propel nut gripping the bore 102. Nut 109A is located on the threaded stud 103A beneath the flange of the propel nut. Nut 109A is integral with roller 809. Roller 809 is located at the bottom of the side wall of the desk. The threaded stud 103A and the side wall of the desk rests on the roller 809.

Referring to FIGS. 8-8D, when the furniture is moved, the bore in the substrate, the end caps, the propel nut and the flange of the propel nut absorb the moment applied due to the threaded stud.

LIST OF REFERENCE NUMERALS

100 cross-section view of the prior art leveler of FIG. 1
101 wood, plywood, or pressboard substrate
102 bore or aperture in substrate
103 threads
103A threaded stud
104 propel nut
105 skive of propel nut
106 bottom surface of wood, plywood, or pressboard substrate
107 flange of propel nut
108 contact surface of flange
109 leveler
109A nut
109B outer surface of leveler for engagement with the floor
120 cylindrical end of stud
130 deformation in substrate
200 bottom view of the prior art leveler in substrate
201 cracks in surface of substrate
210 distortions in substrate
300 exploded perspective view of leveler
300A perspective view of assembled leveler
300B top view of leveling device
300C cross sectional view along line 3C-3C
301 rolled end cap
302 seam of rolled end cap
303 top end of stud
304 internal threads of propel nut
315 radius of propel nut joining barrel
320 end cap fit over cylinder in the bore
400 exploded assembly view of leveler
401 press fit end cap
500 exploded assembly view of leveler with shorter propel nut
504A extended length of propel nut
504 shorter propel nut
600 perspective view of leveler with adjusted position of propel nut
600A perspective view of leveler with long threaded stud
600B partial cross-sectional view of leveler in substrate
600C partial cross-sectional view of leveler in substrate
600D partial cross-sectional view of leveler with force applied perpendicularly to the leveler
600E partial cross-sectional view of leveler with force applied perpendicularly to the leveler
601 rolled end cap
601B support of end cap in plastic substrate
602 seam of rolled end cap
604 propel nut
610 plastic substrate
611 support of propel nut embedded in substrate
612 support of end cap of cylinder end of threaded stud in the bore
613 support of end cap of cylinder end of threaded stud in the bore
700 partial cross section view of propel nut with pointed flanges
700A end view of propel nut with toothed flanges
700B partial cross section view of propel nut with extended rectangular flange
700C view of propel nut with generally rectangular flanges
700D partial cross section view of propel nut with extended downward directed arc-shaped flange
700E view of propel nut with extended downward directed arc-shaped flange
701 slab base 2 prong tee nut
702, 702A prongs
703 flange of slab base 2 prong tee nut
704 rectangular flange of propel nut
705, 706 aperture
707 shaft of propel nut with rectangular flange
708 extended wing on flange
709 extended wing on flange
710 flange
711 shaft of propel nut
800 perspective view of side wall of desk using improved leveling device
800B perspective view of file cabinet using improved leveling device
801 furniture,
802 side wall of furniture
803 cutout of sidewall of furniture
809 roller
F force applied perpendicular to the threaded stud
M-moment
M1-moment Those skilled in the art will realize that the invention has been set forth with particularity by way of example only and that many changes may be made to the invention without departing from the spirit and scope of the appended claims.

The invention claimed is:

1. A leveling device for furniture, comprising: furniture, said furniture includes a bore for receiving said leveling device; a leveler, a propel nut, and an end cap; said leveler includes a threaded stud; said threaded stud includes a first end and a second end; said first end of said threaded stud includes an unthreaded portion and said unthreaded portion receives an end cap mounted therearound; said second end has a leveler body; said threaded stud has an integral nut intermediate said leveler body and said end cap; said propel nut includes a bore therethrough and internal threads therein; said threaded stud interengages said internal threads of said propel nut; said propel nut resides intermediate said nut and said first end of said threaded stud and engages said bore; said propel nut, said threaded nut, and said end cap mounted around said first end of said threaded stud are inserted into said bore of said furniture; and, said threaded stud and said end cap are resistably movable rotationally and translationally with respect to said bore.

2. A leveling device as claimed in claim 1 wherein said propel nut has a flange and said flange engages said furniture.

3. A leveling device as claimed in claim 2 where said flange of said propel nut has skives which are inserted in said bore.

4. A leveling device as claimed in claim 2, wherein said leveler body includes a leveling surface and said flange has a greater diameter than said leveling surface.

5. A leveling device as claimed in claim 2, wherein said leveler body includes a leveling surface and said integral nut of said threaded stud is located intermediate said leveling surface and said flange of said propel nut.

6. A leveling device for use in furniture, comprising: furniture; a leveler; said leveler includes a foot, a partially threaded stud, and an end cap surrounding said stud where it is not threaded; a propel nut having a bore therethrough and having internal threads in said bore; a bore in said furniture; said partially threaded stud engaging said threads of said propel nut; said propel nut interengaging said furniture and said bore in said furniture securing said propel nut relative to said furniture; said end cap residing in said bore; said partially threaded stud residing partially in said bore and continuously adjustable between a first fully extended position and a second fully inserted position.

7. A leveling device for use in furniture as claimed in claim 6 wherein said propel nut includes a flange which interengages said furniture, and wherein said bore in said furniture in combination with said propel nut and, said end cap, and said flange counteracts the moment applied by a force acting against said foot of said leveler orthogonal to said orientation of said threaded stud.

* * * * *